US009108770B2

(12) United States Patent
Schieber

(10) Patent No.: US 9,108,770 B2
(45) Date of Patent: Aug. 18, 2015

(54) RE-SEALABLE PACKAGING

(71) Applicant: C-P CONVERTERS, INC., York, PA (US)

(72) Inventor: William C. Schieber, Easton, PA (US)

(73) Assignee: C-P Converters, Inc., York, PA (US)

( * ) Notice: Subject to any disclaimer, the term of this patent is extended or adjusted under 35 U.S.C. 154(b) by 73 days.

(21) Appl. No.: 13/924,726

(22) Filed: Jun. 24, 2013

(65) Prior Publication Data

US 2014/0376836 A1 Dec. 25, 2014

(51) Int. Cl.

| | |
|---|---|
| ***B65D 33/20*** | (2006.01) |
| ***B31B 1/90*** | (2006.01) |
| ***B65D 77/14*** | (2006.01) |

(52) U.S. Cl.

CPC ..... *B65D 33/20* (2013.01); *B65D 77/14* (2013.01); *Y10T 428/14* (2015.01); *Y10T 428/149* (2015.01); *Y10T 428/1476* (2015.01)

(58) Field of Classification Search

CPC ..... B65D 33/20; B65D 77/14; B31B 1/90; Y10T 428/14; Y10T 428/1476; Y10T 428/149; Y10T 428/1495; Y10T 428/15

See application file for complete search history.

(56) References Cited

U.S. PATENT DOCUMENTS

| | | | | |
|---|---|---|---|---|
| 5,044,776 | A | 9/1991 | Schramer et al. | |
| 5,078,509 | A | 1/1992 | Center et al. | |
| 5,582,889 | A | 12/1996 | Pedrini | |
| 5,824,380 | A * | 10/1998 | Hagen | 428/41.9 |
| 6,383,592 | B1 | 5/2002 | Lowry et al. | |
| 6,436,500 | B1 | 8/2002 | Yingst et al. | |
| 6,517,243 | B2 | 2/2003 | Huffer et al. | |
| 6,746,743 | B2 | 6/2004 | Knoerzer et al. | |
| 7,189,300 | B2 | 3/2007 | Knoerzer et al. | |
| 7,416,768 | B2 | 8/2008 | Knoerzer et al. | |
| 7,686,513 | B2 | 3/2010 | Knoerzer et al. | |
| 7,703,980 | B2 | 4/2010 | Sampaio Camacho | |
| 7,963,413 | B2 | 6/2011 | Sierra-Gomez et al. | |
| 2002/0114541 | A1 * | 8/2002 | Huffer et al. | 383/89 |
| 2004/0175060 | A1 | 9/2004 | Woodham et al. | |
| 2010/0278454 | A1 | 11/2010 | Huffer | |
| 2013/0020328 | A1 * | 1/2013 | Duan et al. | 220/359.3 |

FOREIGN PATENT DOCUMENTS

| | | | |
|---|---|---|---|
| EP | 968928 | A1 * | 1/2000 |

* cited by examiner

*Primary Examiner* — Patricia L Nordmeyer

(74) *Attorney, Agent, or Firm* — McNees Wallace & Nurick LLC

(57) ABSTRACT

A re-sealable package and method which includes roll stock, a pressure sensitive label and a release member. The re-sealable package includes an outer layer laminated to an inner sealant layer. The pressure sensitive label has a first preselected shape and includes a pressure sensitive adhesive on one side. The side having the pressure sensitive layer is adhered to the inner sealant layer of the roll stock. The release member is formed in the outer layer, the release member having a second preselected shape which is smaller than the first preselected shape of the pressure sensitive label. As the release member is lifted from the pressure sensitive label, an area of the pressure sensitive adhesive is exposed to allow portions of the package to be removably adhered to the area of pressure sensitive adhesive.

19 Claims, 9 Drawing Sheets

RE-SEALABLE PACKAGING

FIELD OF THE INVENTION

The present invention is directed to re-sealable packaging, and more specifically, an improved, re-sealable package having a separated portion of the roll stock that serves as the re-sealable mechanism.

BACKGROUND OF THE INVENTION

Products such as food and personal care items are provided in packages that provide for access. The packages protect the product from damage during shipping and handling; seal the product to prevent the product from deterioration due to environmental conditions for predetermined periods of time and as a storage vessel. Once opened, while most containers can be reclosed, the effectiveness of the closing arrangement varies widely.

A typical film bag is made from a laminate that includes an outer film layer adhesively secured to an inner sealing layer. The outer layer is usually made from a material that facilitates printing. The inner layer is usually made from a material that enables the package to be sealed. Other layers can also be incorporated. Properties, such as permeability to oxygen and moisture, strength, stiffness and other packaging requirements may dictate material selection. The outer and inner layers are both typically made from plastic film, such as polyethylene or polypropylene.

Some packaging can be reclosed after opening by folding the end over or by rolling the end down. When sufficient material is available, the packaging may be reclosed with a twist tie, a wire or wire-like length of material twisted around excess packaging. This method for sealing the contents of the packaging makes it more likely that the contents of the packaging are exposed to environmental conditions that accelerate deterioration.

Various methods of preventing the conventional bag from reopening have been attempted. Household items such as clothes pins or paper clips have been used to hold the conventional bag closed. In addition, clips have been specially designed and manufactured as closures for bags.

Other attempts to provide a closure mechanism for a conventional bag have tried to provide a closure device with the bag itself. Some bags have been provided with a metal wire or strip along the length of the bag, the wire or strip being easily bent under the user's manipulation, but resisting the tendency of the bag to open once folded, thus keeping the bag closed. Other bags are provided with nonresilient flexible strips disposed transversely to the length of the bag. The nonresilient strip is along the top of the bag and extends beyond the side of the bag. Once the top of the bag is rolled down a first side, the extending portion of the strip is folded snugly against a second side, opposite the first side, preventing the bag from unrolling.

Recently, re-sealable food containers have been developed that include strips of pressure sensitive adhesive tape adhered to the outside of the roll stock. This pressure sensitive adhesive tape provides a mechanism to allow the bag to be folded or rolled down and make contact with the pressure sensitive adhesive tape creating a closure. Alternatively, when the bag is closed and folded downwardly, the portion with releasable adhesive may be attached to the folded portion, thereby preventing the bag from unrolling. One problem with a retrofitted closure tab is the expense of manufacturing and handling the tab.

An additional re-sealable container is disclosed in U.S. Pat. No. 7,416,768. The package has an inner layer and an outer layer which are laminated together. The outer layer of the packaging film is cut completely through, so that a strip of the outer layer is no longer connected to the rest of the layer. By adjusting the bond between the outer layer and the inner layer, the strip can be peeled away from the rest of the film without injuring the barrier layer that is part of the inner loop. The adhesive layer concealed beneath the removable strip can serve as a closure for a partially full bag.

Further improvements in re-sealable food packages that improve the durability, effectiveness and repeatability of the resealable package are desired.

SUMMARY OF THE INVENTION

An embodiment is directed to a re-sealable package formed of roll stock and a pressure sensitive label. The roll stock has an outer layer laminated to an inner sealant layer. The pressure sensitive label has a first preselected shape and includes a pressure sensitive adhesive on one side. The side having the pressure sensitive layer is adhered to the inner sealant layer of the roll stock. A die cut extends completely through the roll stock and partially through a thickness of the pressure sensitive label in a second preselected shape, thereby forming a release member. Wherein as the release member is lifted from the label along the die cut, an area of the pressure sensitive adhesive is exposed to allow portions of the package to be removably adhered to the area of pressure sensitive adhesive.

An embodiment is directed to a re-sealable package which includes roll stock, a pressure sensitive label and a release member. The re-sealable package includes an outer layer laminated to an inner sealant layer. The pressure sensitive label has a first preselected shape and includes a pressure sensitive adhesive on one side. The side having the pressure sensitive layer is adhered to the inner sealant layer of the roll stock. The release member is formed in the outer layer, the release member having a second preselected shape which is smaller than the first preselected shape of the pressure sensitive label. As the release member is lifted from the pressure sensitive label, an area of the pressure sensitive adhesive is exposed to allow portions of the package to be removably adhered to the area of pressure sensitive adhesive.

An embodiment is directed to a method of forming a re-sealable package for foodstuffs and personal care products. The method includes: providing roll stock having an outer layer laminated to an inner sealant layer; providing a pressure sensitive label having a first preselected shape and applying a deadening agent to a portion of the label; applying the pressure sensitive label to the inner sealant layer; die cutting through the roll stock from the outer layer to form a release member having a second preselected shape which is smaller than the first preselected shape of the pressure sensitive label; removing the release member to expose an adhesive area; and removably adhering portions of the package to the adhesive area.

A re-sealable package for food and personal care products that provides protection for the products until open, and provides easy reclosure of the package when folded or rolled down. The present invention addresses the above needs and achieves other advantages, by providing a flexible packaging structure and method for making same, in which the structure has a built-in reclose feature that utilizes a separate pressure sensitive label attached to the sealant layer side of the roll stock. The roll stock, once it is die-cut from the side opposite the attached pressure sensitive label, will expose a portion of the reseal label to the outside of the roll stock, providing a re-sealable action.

The re-sealable package comprises roll stock that is formed into a package. The roll stock is formed of an outside layer, usually reverse printed that is laminated to at least a second layer or subsequent layers. A pressure sensitive adhesive is applied to a separate substrate, which may be printed, but which is die-cut to form a pressure sensitive label. A coating is applied to a small area of the label to prevent the adhesive from being effective in this area. This small area on the pressure sensitive label serves to form a pull-back a tab on the separated portion of the roll stock. This pressure sensitive label is applied to the roll stock. The roll stock is then die-cut from the side opposite the applied pressure sensitive label to subsequently create the opening/re-seal feature.

The package may assume any three-dimensional shape and may include a separate internal structure to provide rigidity for support when necessary. The die-cut in the roll stock provides an area that can be readily removed. Underlying the cut area of the roll stock is an exposed portion of the pressure sensitive label. The die-cut allows a portion of the roll stock to separate from the pressure sensitive label which has been uniquely applied to the underside of the roll stock. The separated portion of roll stock material is removed exposing a portion of the sensitive label. Once the roll stock is rolled down or folded over it will adhere to the area of exposed pressure sensitive adhesive. This creates a re-sealed package.

While the die-cut in its simplest form may be substantially straight lines, the design of the die-cut may assume any other pattern.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
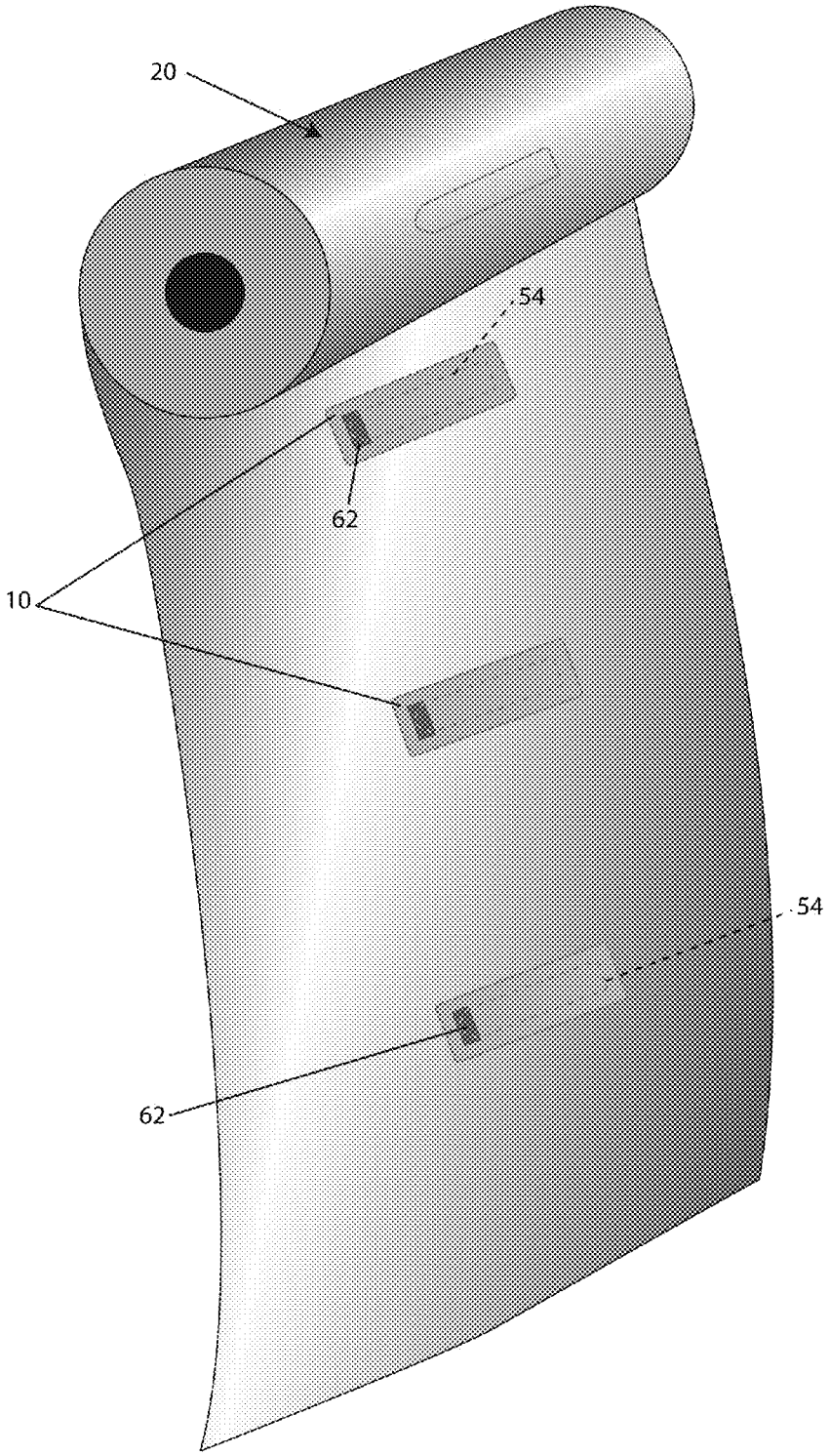
FIG. 1 illustrates an exemplary roll stock of packaging containing periodically spaced horizontal pressure sensitive labels with release members adhered thereto.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that spatially relative terms, such as "top", "upper", "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "over" other elements or features would then be oriented "under" the other elements or features. Thus, the exemplary term "over" can encompass both an orientation of over and under. The device may be otherwise oriented (rotated 90 degrees or at other orientations) and the spatially relative descriptors used herein interpreted accordingly.

A re-sealable package 2 for food and personal products that provides a resealable mechanism is described herein. As will be described, a separate portion of the roll stock 20 serves as the re-sealable mechanism.

Figure 2:
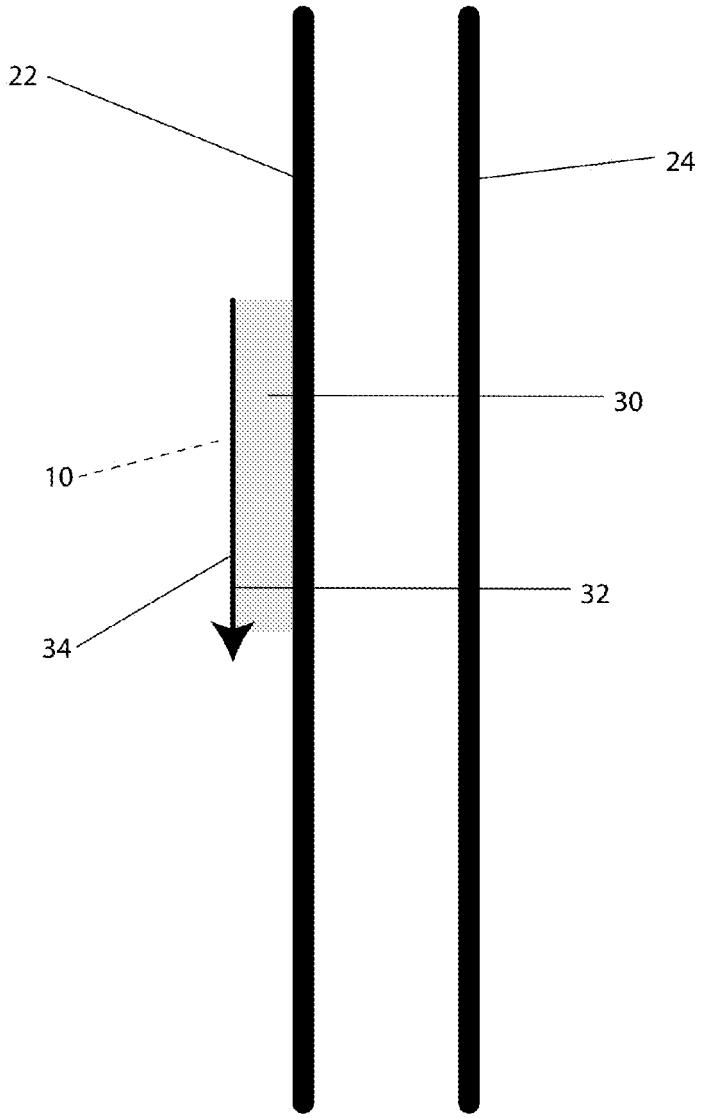
FIG. 2 is a cross-sectional view taken along lines 2-2 of FIG. 1, illustrating the different layers of the roll stock and the pressure sensitive labels.

As best shown in FIG. 2, roll stock 20 comprises at least an inside sealant layer 22 and an outside layer 24 laminated together. After lamination, they are cut to the same width and length if they are not the same width or length before or during the lamination process. Additional layers may be included in the lamination between the inside sealant layer 22 and the outside layer 24, if desired. The outside layer 24 may be a flexible film made from materials, such as, but not limited to polyolefins, polystyrenes, polyimides, and more specifically polyester or polyethylene terephthalate (PET). The outside layer 24 may be printed on either side by reverse printing or by surface printing. Thus, product identification or any other information, including any trademarks, may be applied to the roll stock so that the source of the goods within the package and any other information can be readily viewed by the consumer or purchaser. The inside sealant layer 22 usually provides protection that prevents entry of sunlight and/or air when the product that is used with the roll stock 20 is a food item. The inside sealant layer 22, like the outside layer 24, is flexible and is made from materials, such as, but not limited to, polypropylene, oriented polypropylene (OPP), polyethylene or a similar polymer film. The polymer film may be coated with a metal, such as by a vacuum deposition process. The inside sealant layer 22 and the outside layer 24 can be laminated together (including to any additional layers) by any known lamination technique including heat sealing, pressure bonding, and adhesive bonding, including the extrusion laminating process. The lamination process results in roll stock 20 having at least two layers, an outside layer 24 having an exposed surface and an inside sealant layer 22 having an exposed surface. Any additional layers that may be present lie between the inside sealant layer 22 and the outside layer 24, the additional layers not having an exposed surface.

Labels are manufactured from material, such as, but not limited to a film or paper, coated with a pressure sensitive adhesive to form a pressure sensitive label 10. The film may be selected, for example, from oriented polypropylene (OPP) polyester or similar polymers. In one embodiment, each label 10 has a first preselected shape, such as a generally rectangular shape, although any other shape may be used. A deadening agent is applied to a selected area 62 of label 10. The deadening agent masks the effects of the adhesive so that the area 62 to which it is applied will not adhere to the roll stock 20, enabling that portion of the roll stock 20 to act as a the tab 52 which can be grasped and lifted away from the label 10, as will be more fully described.

Each pressure sensitive label 10 is applied to roll stock 20. As noted above, pressure sensitive label 10 includes a pressure sensitive adhesive 30 applied to one side 32. The pressure sensitive label 10 is applied to the inside sealant layer 22 of roll stock 20, such that an exposed surface 34 of the non-coated side 36 of the pressure sensitive label 10 will face the product being packaged. The labels 10 may be applied onto roll stock 20 from a separate spool, such that the side 32 of label 10 having the adhesive 30 is contacted to inside sealant layer 22 of the roll stock 20 as labels 10 are unspooled from a spool and separated and cleanly removed from a release liner.

Figure 3:
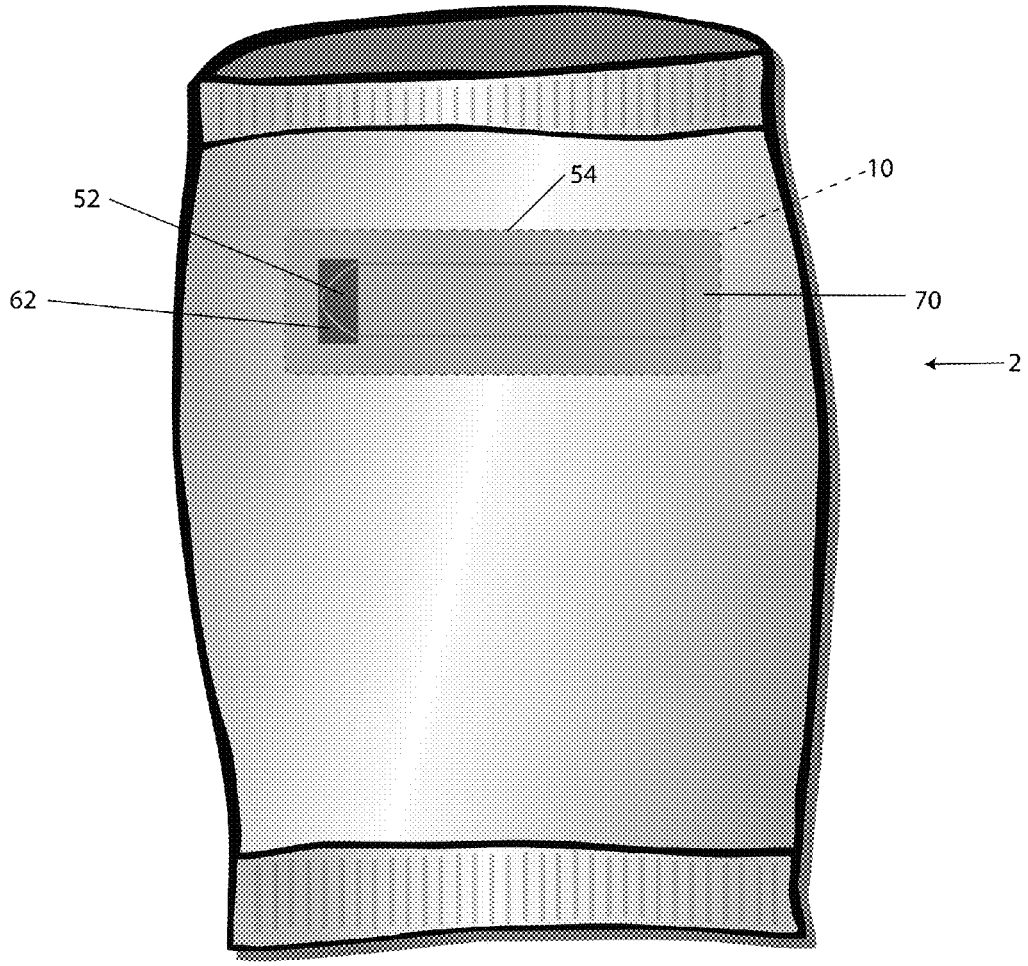
FIG. 3 illustrates an exemplary package formed from the roll stock of FIG. 1 having a horizontal pressure sensitive label with a release member adhered thereto.
Figure 4:
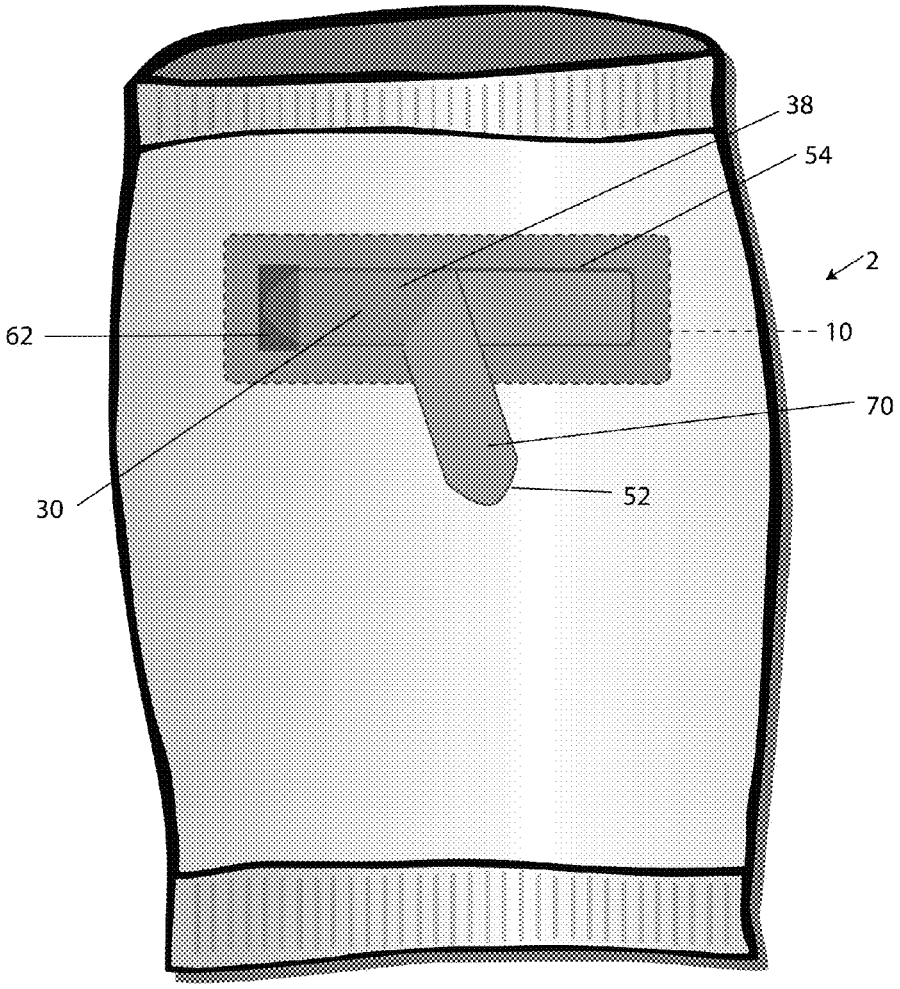
FIG. 4 illustrates the exemplary formed package of FIG. 3, having a horizontal pressure sensitive label with a release member partially removed therefrom.
Figure 5:
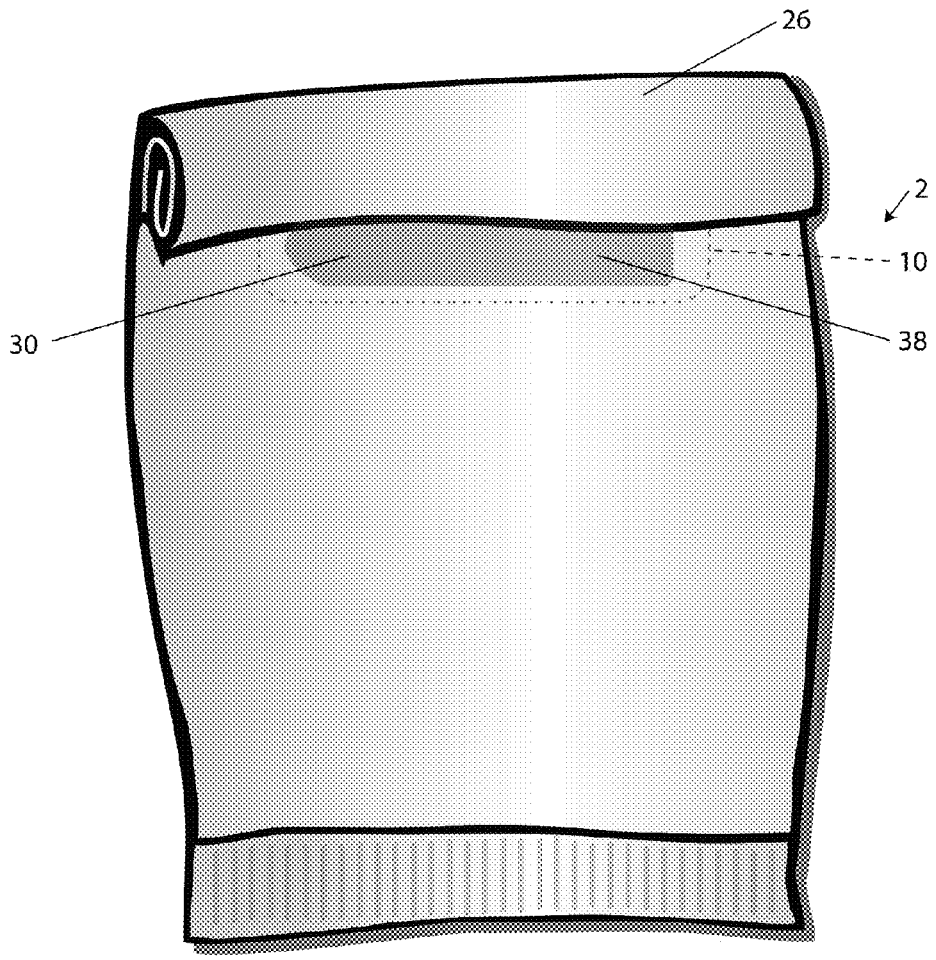
FIG. 5 illustrates the exemplary formed package of FIG. 4, having a horizontal pressure sensitive label with a release member removed and a rolled down or folded portion of the packaged positioned over and adhered to the area of exposed pressure sensitive adhesive of the pressure sensitive label.
Figure 6:
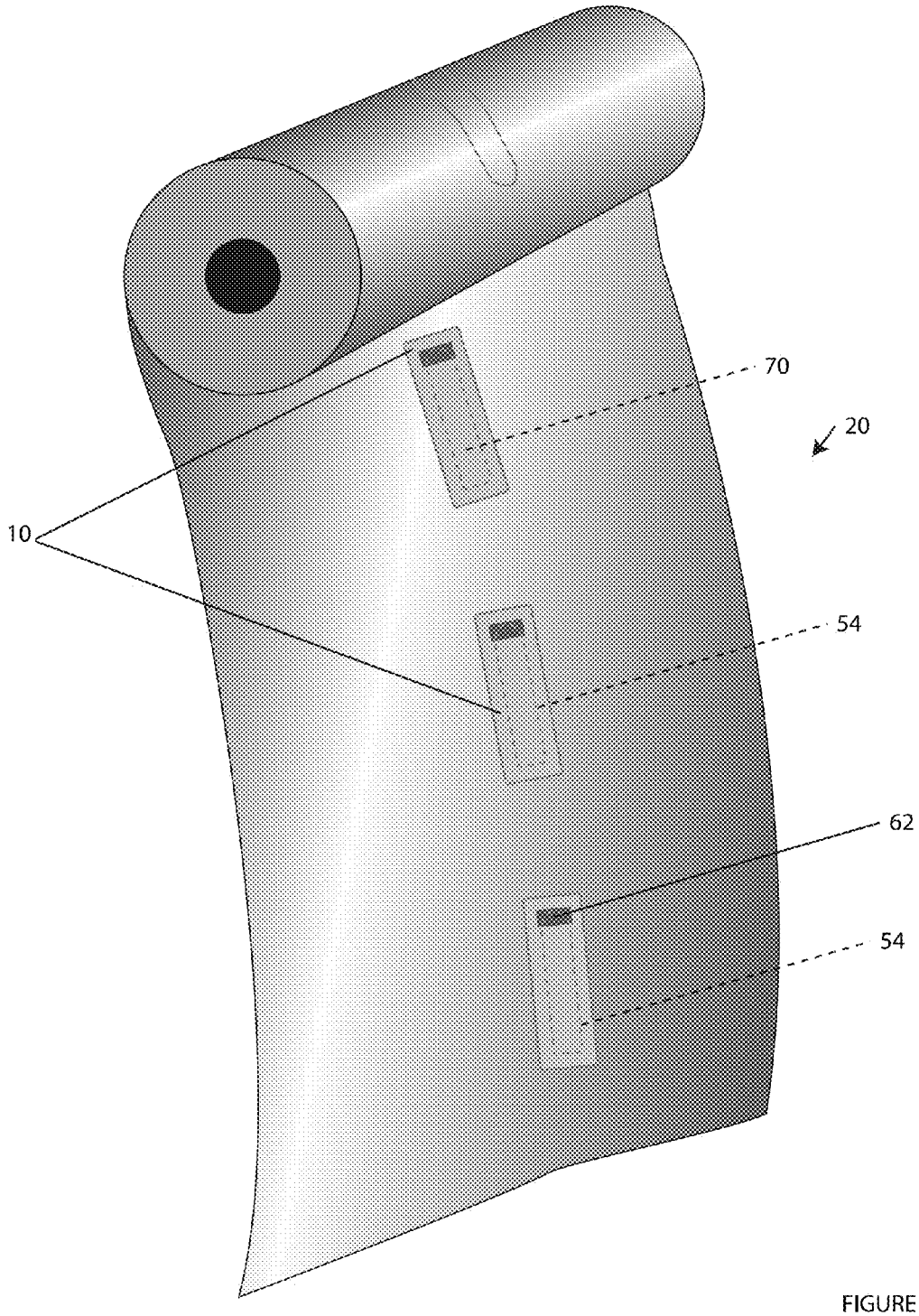
FIG. 6 illustrates an exemplary roll stock of packaging containing periodically spaced vertical pressure sensitive labels with release members adhered thereto.
Figure 7:
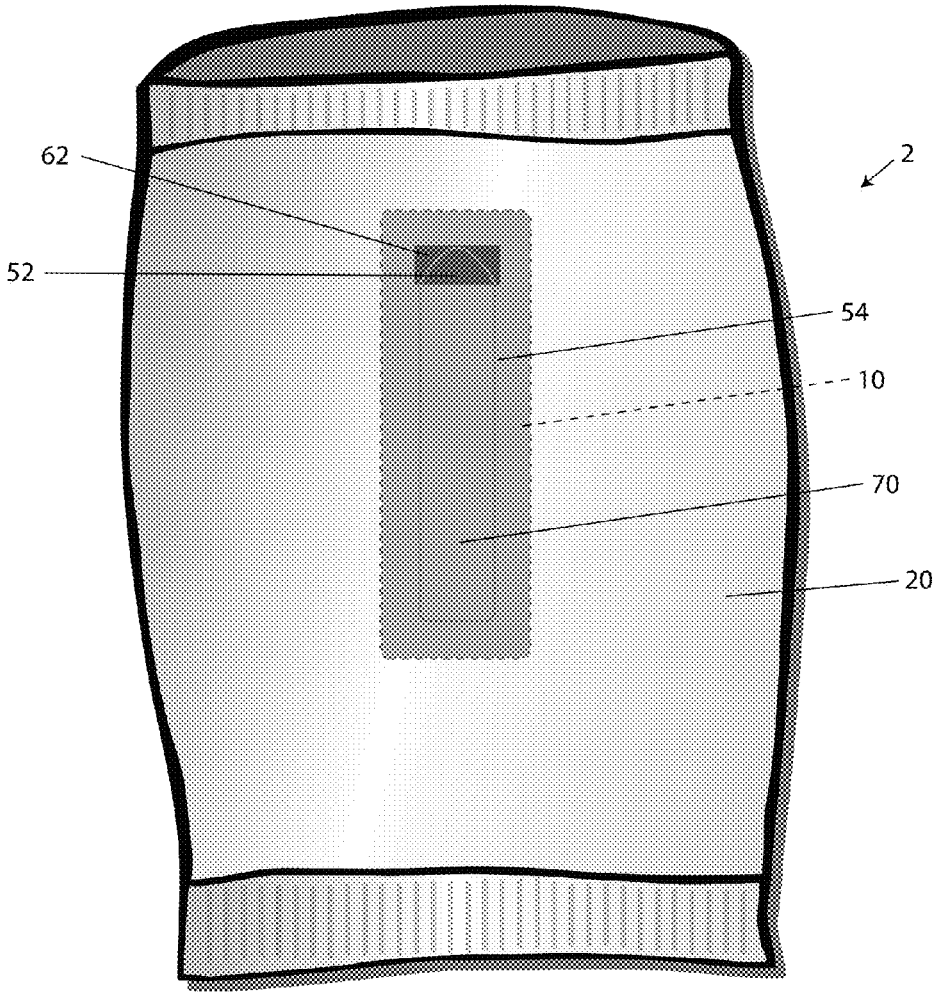
FIG. 7 illustrates an exemplary package formed from the roll stock of FIG. 6 having a vertical pressure sensitive label with a release member adhered thereto.
Figure 8:
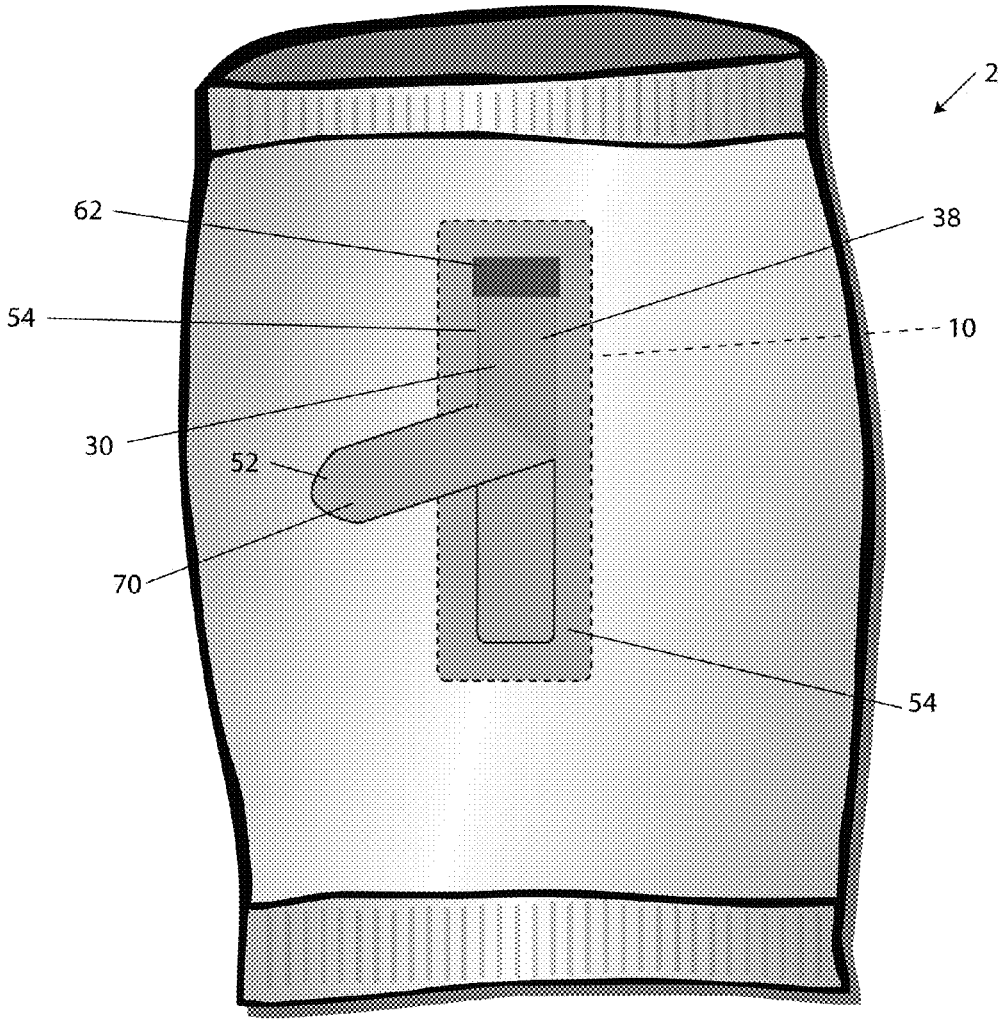
FIG. 8 illustrates the exemplary formed package of FIG. 7, having a vertical pressure sensitive label with a release member partially removed therefrom.
Figure 9:
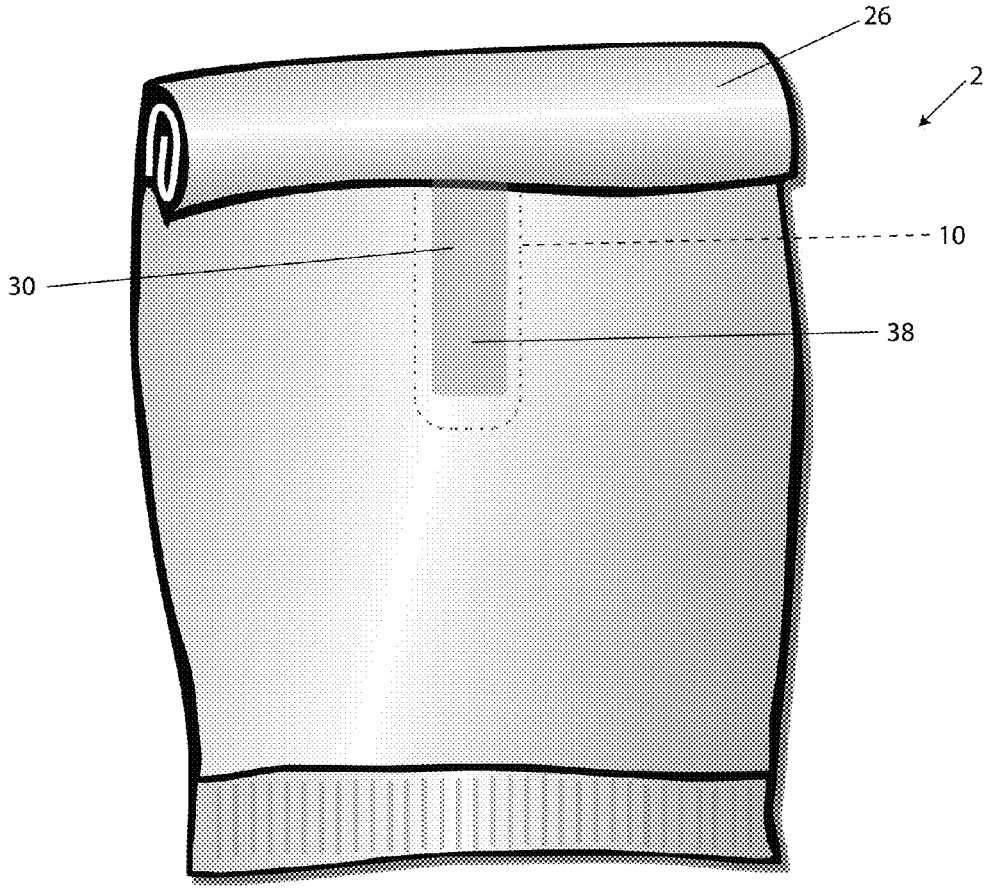
FIG. 9 illustrates the exemplary formed package of FIG. 8, having a vertical pressure sensitive label with a release member removed and a rolled down or folded portion of the packaged positioned over and adhered to the area of exposed pressure sensitive adhesive of the pressure sensitive label.

As shown in FIGS. 1 and 6, die-cuts 54 are made into roll stock 20 from the side of roll stock 20 opposite the label 10 to form a release member 70. The release member 70 may be formed in many different shapes, including, but not limited to a strip extending along the longitudinal axis of the package 2 (FIGS. 7 through 9) or a strip extending perpendicular to the longitudinal axis of the package 2 (FIGS. 3 through 5). The release member 70 has a second predetermined shape which is small than the first predetermined shape of the label 10. Die-cuts 54 are formed in roll stock 20 so that they overlap the shape of pressure sensitive label 10 applied to the exposed layer of the inside sealant layer 22. Die-cuts 54 penetrate the outside layer 24, the inside sealant layer 22 and any intermediate layers of roll stock 20 to form the releasable strip or member 70. The die-cuts 54 may also extend partially through a thickness of the pressure sensitive label 10, thereby ensuring that the die-cuts 54 completely cut through the roll stock 20. The roll stock material, having been die-cut, is now ready to be formed into packaging for receiving product. However, the die-cut roll stock material is usually rolled into a coil until it is ready for forming into a package. Typically, the processing of roll stock up to this point is done by a packaging supplier and coils of die cut roll stock material are shipped to the product manufacturer until the product manufacturer has available product and is ready to form a package from the die cut roll stock material.

In use, as best shown in FIGS. 3 through 5 and 7 through 9, the releasable member 70 is peeled back by grasping a lift tab 52 of the release member 70 to expose an adhesive area 38 of the label 10. The lift tab 52, which cooperates with the deadening agent applied to the pressure sensitive label 10 opposite to it, can be grasped by the user. As the lift tab 52 is pulled back away from the package 2, the release member 70 separates from package 2 along die-cuts 54 because roll stock 20 has been cut through along die-cut. Once the releasable member 70 or a portion thereof is separated and peeled back, the adhesive area 38 or strip is exposed on the outside of the package 2.

The die-cut 54 in the roll stock 20 provides a releasable area or member 70 that can be readily removed. Underlying the cut area of the roll stock 20 is an exposed adhesive area or portion 38 of the pressure sensitive label 10. The die-cut 54 allows a portion of the roll stock 20 to separate from the pressure sensitive label 10 which has been uniquely applied to the underside of the roll stock 20. The releasable strip or member 70 of roll stock 20 is removed exposing the adhesive strip or area 38 of the pressure sensitive label 10. Once the package 2 is opened and the user wishes to reseal the package 2, remaining roll stock 20 of the package 2 is rolled down or folded to close the package 2. The rolled down or folded portion of the roll stock 20 which forms the package 2 is positioned over the exposed area 38 of the pressure sensitive label 10 and will be removably adhered to the exposed area 38. This creates the re-sealed package 2.

The die-cuts 54 penetrate roll stock 20. Die-cuts 54 cut through roll stock 20, penetrating the roll stock material opposite the side to which label 10 is applied, so that the adhesive area 38 is readily exposed by lifting tab 52 and release member 70. Alternatively, die-cuts 54 may not completely cut through the thickness of the roll stock 20 providing a weakened perimeter along which the roll stock 20 will tear as the tab 52 and release member 70 are pulled back.

In one embodiment, die-cuts 54 forming the release member 70 extend around less than all sides, i.e., three sides, of the release member 70. In this embodiment the release member 70 cannot be completely removed from the package 2 without damaging package 2. In another embodiment the die-cuts 54 extend around all sides of the release member 70, allowing the release member 70 to be completely removed from the package 2.

Package 2 may take any form, the form selected depending on product. Products of various shapes and sizes are used in vertical and horizontal filling applications. The shape of package 2 is determined by the product.

Die-cuts 54 may be in the form of straight cuts. Alternatively, the design of the die-cuts 54 may assume any pattern, thereby allowing the release member 70 and the exposed adhesive area 38 to be formed in any desired shape.

The pressure sensitive adhesive 30 exposed in the adhesive area 38 has sufficient strength to permit the package 2 to be opened and resealed a plurality of times. Preferably, the pressure sensitive adhesive 30 has sufficient strength for at least 10 openings and reseals of the rolled down or folded portion 26 of the package 2 to the adhesive area 38.

Labels 10 may be cut to size and applied, preferably mechanically to roll stock 20. Alternatively, roll stock 20 may be cut to the size of packaging 2 and then labels 10, previously cut to size, may be applied to the sized roll stock prior to forming the cut roll stock into packaging.

The method of forming a re-sealable package for foodstuffs and personal care products is also disclosed and includes the steps of: providing roll stock 20 having an outer layer 24 having an exposed surface laminated to a inner sealant layer 22 having an exposed surface; providing a pressure sensitive label 10 having a preselected shape and applying a deadening agent to a portion 62 of the label 10; applying the pressure sensitive label 10 to the exposed surface of the inner sealant layer 22; die cutting through the roll stock 20 from the outer layer 24 to form a release member 70 which may be removed to expose an adhesive area 38. Additional options steps include: partially die cutting through the pressure sensitive adhesive label 10 without completely penetrating the pressure sensitive adhesive label 10; forming the pressure sensitive label 10 from a film: applying graphics to the film; applying adhesive to the film; and/or applying graphics to the roll stock 20.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A re-sealable package comprising:

roll stock, the roll stock further comprising an outer layer laminated to an inner sealant layer;

a pressure sensitive label having a first preselected shape and including a pressure sensitive adhesive on one side, the side having the pressure sensitive layer adhered to the inner sealant layer of the roll stock;

a release member formed in the outer layer, the release member having a second preselected shape which is smaller than the first preselected shape of the pressure sensitive label;

wherein as the release member is lifted from the pressure sensitive label, an area of the pressure sensitive adhesive is exposed to allow portions of the package to be removably adhered to the area of pressure sensitive adhesive.

2. The releasable package as recited in claim 1, wherein a tab is positioned on the release member, the tab cooperating with a deadening agent provided on the pressure sensitive label.

3. The releasable package as recited in claim 1, wherein the outside layer is printed on by reverse printing or by surface printing.

4. The releasable package as recited in claim 1, wherein the inside sealant layer provides protection that prevents entry of sunlight and/or air into the package.

5. The releasable package as recited in claim 1, wherein the pressure sensitive label is film or paper coated with a pressure sensitive adhesive.

6. The releasable package as recited in claim 5, wherein a selected area of the pressure sensitive label has a deadening agent to mask the effects of the pressure sensitive adhesive.

7. The releasable package as recited in claim 6, wherein the release member is a strip extending along the longitudinal axis of the package.

8. The releasable package as recited in claim 6, wherein the release member is a strip extending perpendicular to the longitudinal axis of the package.

9. The releasable package as recited in claim 6, wherein the release member overlaps the shape of pressure sensitive label.

10. A re-sealable package comprising:

roll stock, the roll stock further comprising an outer layer laminated to an inner sealant layer;

a pressure sensitive label having a first preselected shape and including a pressure sensitive adhesive on one side, the side having the pressure sensitive layer adhered to the inner sealant layer of the roll stock;

a cut extends completely through the roll stock and partially through a thickness of the pressure sensitive label in a second preselected shape, thereby forming a release member;

wherein as the release member is lifted from the label along the cut, an area of the pressure sensitive adhesive is exposed to allow portions of the package to be removably adhered to the area of pressure sensitive adhesive.

11. The releasable package as recited in claim 10, wherein the release member has a second predetermined shape which is small than the first predetermined shape of the pressure sensitive label.

12. The releasable package as recited in claim 10, wherein a tab is positioned on the release member, the tab cooperating with a deadening agent provided on the pressure sensitive label.

13. The releasable package as recited in claim 10, wherein the outside layer is printed on by reverse printing or by surface printing.

14. The releasable package as recited in claim 10, wherein the inside sealant layer provides protection that prevents entry of sunlight and/or air into the package.

15. The releasable package as recited in claim 10, wherein the pressure sensitive label is film or paper coated with a pressure sensitive adhesive.

16. The releasable package as recited in claim 10, wherein a selected area of the pressure sensitive label has a deadening agent to mask the effects of the pressure sensitive adhesive.

17. The releasable package as recited in claim 10, wherein the release member is a strip extending along the longitudinal axis of the package.

18. The releasable package as recited in claim 10, wherein the release member is a strip extending perpendicular to the longitudinal axis of the package.

19. The releasable package as recited in claim 10, wherein the release member overlaps the shape of pressure sensitive label.

* * * * *